US008042318B2

(12) United States Patent
Ayats et al.

(10) Patent No.: US 8,042,318 B2
(45) Date of Patent: Oct. 25, 2011

(54) PROCESS FOR PREPARING A WATER-SOLUBLE CONTAINER WITH TWO COMPARTMENTS

(75) Inventors: Francesc Ayats, Barcelona (ES); Frederic Moreux, Ludwigshafen (DE); Jordi Salvador, Barcelona (ES); Ralf Wiedemann, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 12/652,539

(22) Filed: Jan. 5, 2010

(65) Prior Publication Data

US 2010/0180549 A1 Jul. 22, 2010

Related U.S. Application Data

(62) Division of application No. 11/570,797, filed on Feb. 14, 2007, now abandoned.

(30) Foreign Application Priority Data

Jun. 19, 2004 (GB) ..... 0413753.5

(51) Int. Cl.
*B65B 47/10* (2006.01)
*B65B 47/02* (2006.01)

(52) U.S. Cl. ..... 53/453; 53/449; 53/474; 53/171; 53/559

(58) Field of Classification Search ..... 53/449, 53/452, 453, 474, 477, 171, 559, 561, 240, 53/329.2, 329.3
See application file for complete search history.

(56) References Cited

U.S. PATENT DOCUMENTS

| | | | | |
|---|---|---|---|---|
| 3,465,873 | A * | 9/1969 | Munz | 206/205 |
| 4,349,997 | A * | 9/1982 | Hayasaka et al. | 53/51 |
| 4,411,358 | A * | 10/1983 | Bennwik et al. | 206/771 |
| 4,540,089 | A * | 9/1985 | Maloney | 206/219 |
| 4,680,916 | A * | 7/1987 | Ginn | 53/440 |
| 5,224,601 | A * | 7/1993 | Gouge et al. | 206/524.7 |
| 6,037,319 | A * | 3/2000 | Dickler et al. | 510/439 |
| 6,378,274 | B1 * | 4/2002 | Harbour | 53/453 |
| 6,895,731 | B2 * | 5/2005 | Lehner et al. | 53/559 |
| 7,490,456 | B2 * | 2/2009 | Draisey et al. | 53/560 |
| 7,578,114 | B2 * | 8/2009 | Duffield et al. | 53/476 |
| D621,718 | S * | 8/2010 | Mehdizadeh | D9/707 |
| 2002/0033004 | A1 * | 3/2002 | Edwards et al. | 53/453 |
| 2003/0108705 | A1 * | 6/2003 | Duffield et al. | 428/36.6 |
| 2004/0142131 | A1 * | 7/2004 | Edwards et al. | 428/35.7 |
| 2004/0151855 | A1 * | 8/2004 | Duffield et al. | 428/35.7 |
| 2007/0157572 | A1 * | 7/2007 | Oehms et al. | 53/452 |
| 2009/0134054 | A1 * | 5/2009 | Lee et al. | 206/531 |

* cited by examiner

*Primary Examiner* — Paul Durand
(74) *Attorney, Agent, or Firm* — Norris McLaughlin & Marcus, PA

(57) ABSTRACT

A process for preparing a water-soluble container comprising at least two compartments which comprises:

Figure 1:
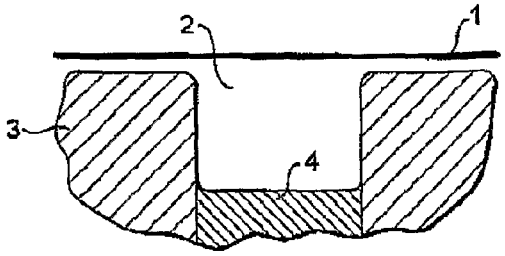

a. forming a first pocket in a first water-soluble film by thermoforming or vacuum forming the first water-soluble film in a mould;
b. filling the first pocket with a first composition;
c. closing the first pocket with a second water-soluble film to produce an intermediate container;
d. moving the intermediate container by deforming the mould to provide a second pocket;
e. filling the second pocket with a second composition; and
f. closing the second pocket with a third water-soluble film.

5 Claims, 1 Drawing Sheet

PROCESS FOR PREPARING A WATER-SOLUBLE CONTAINER WITH TWO COMPARTMENTS

This application is a divisional of U.S. patent application Ser. No. 11/570,797, filed on Feb. 14, 2007, which is a 371 application of PCT/GB2005/002407 filed Jun. 20, 2005, which claims priority to the Great Britain application 0413753.5 filed Jun. 19, 2004.

The present invention relates to a process for preparing a water-soluble container comprising at least two compartments.

It is known to package chemical compositions, particularly those which may be of a hazardous or irritant nature, in films, particularly water-soluble films. Such containers can simply be added to water in order to dissolve or disperse the contents of the container into the water. Examples of such containers are disclosed in WO 89/12587 and WO 92/17382.

Such containers have, however, a number of difficulties. In particular these containers cannot easily contain two or more compositions because they only have one compartment. Thus they cannot contain two compositions which are incompatible with each other, or a composition which is incompatible with one of the films or sheets used to package the composition unless special precautions are taken.

Water-soluble containers having at least two compartments are also known. For example WO 02/085736 describes a process for preparing a water-soluble container comprising at least two compartments, each compartment being filled with a composition, and covering each compartment with a lid such that the compartments are joined by a folding portion; and folding the folding portion such that the lids of each of the compartments adhere to each other.

WO 02/085738 describes a process for producing a water-soluble article comprising a first compartment containing a first composition and a second compartment comprising a second composition, which comprises producing a first compartment; filling the first compartment with the first composition and either providing a sealing film comprising the second composition and sealing the first compartment with the sealing film or sealing the first compartment with a sealing film; producing a second compartment from the first compartment and/or the sealing film of the first compartment; filling the second compartment with the second composition; and sealing the second compartment with a second sealing film.

It would be desirable to have a further process for preparing water-soluble containers comprising at least two compartments to provide greater choice and flexibility as well as to overcome disadvantages with the above processes. In particular the containers of WO 02/085736 have a disadvantage of having a relatively thick intermediate layer between the two compartments. Furthermore the two compartments generally have to be of a similar size to each other, which may not always be desirable. Additionally the process for preparing the containers requires a folding operation which can be complex to perform on a fast-moving production line. Similarly the containers of WO 02/085738 are not always satisfactory since one compartment must always be significantly smaller than the other compartment. Furthermore, during the manufacturing process a complex registration and alignment procedure is required in order to ensure that the lidding film containing the second compartment is properly placed on top of the first compartment in order to seal it.

The present invention provides a process for preparing a water-soluble container comprising at least two compartments which comprises:

a. forming a first pocket in a first water-soluble film by thermoforming or vacuum forming the first water-soluble film in a mould;
b. filling the first pocket with a first composition;
c. closing the first pocket with a second water-soluble film to produce an intermediate container;
d. moving the intermediate container by deforming the mould to provide a second pocket;
e. filling the second pocket with a second composition; and
f. closing the second pocket with a third water-soluble film.

The process of the present invention can produce water-soluble containers in a single moulding operation leading to a general simplification of the preparation process. The containers can have a particularly attractive appearance since they contain two compositions, which may be identical or different, held in a fixed position in relation to each other. The compositions can easily be differentiated to accentuate their differences. For example, the compositions can have a different physical appearance, or can be coloured differently. They may also have different physical forms. For instance one composition could be a liquid whereas the other could be a powder.

The first, second and third water-soluble films, which may be identical or different, generally comprise a water-soluble polymer (which term is taken to include water-dispersible). Examples of water-soluble polymers are poly(vinyl alcohol) (PVOH), cellulose derivatives such as hydroxypropyl methyl cellulose (HPMC) and gelatine. The PVOH may be partially or fully alcoholised or hydrolysed polyvinyl acetate. For example it may be from 40 to 100%, preferably from 70 to 92%, more preferably about 88 to 92%, alcoholised or hydrolysed. The degree of hydrolysis is known to influence the temperature at which the PVOH starts to dissolve in water. 88% hydrolysis corresponds to a film soluble in cold (i.e. room temperature) water, whereas 92% hydrolysis corresponds to a film soluble in warm water.

The film may be a single film, or a laminated film as disclosed, for example, in GB-A-2,244,258. While a single film may have pinholes, the two or more layers in a laminate are unlikely to have pinholes which coincide. The film may be produced by any process, for example by extrusion and blowing or by casting. The film may be unoriented, monoaxially oriented or biaxially oriented. If the layers in the film are oriented they usually have the same orientation, although their planes of orientation may be different if desired.

The layers in a laminate may be the same or different. Thus they may each comprise the same polymer or a different polymer. If a laminated film is used, each of the layers should be water-soluble. The term "water-soluble" when used herein means that when used in a washing machine, such a fabric or dishwashing machine, the water-soluble aspects of the article are substantially (for example greater than 70%, ideally greater than 85%) dissolved or dispersed into the water. This can be tested by placing the article in 10 litres of agitated water at an appropriate temperature, for example 45° C., for 40 minutes and measuring any undissolved or non-disintegrated pieces of the parts of the article, which are water-soluble, that are left.

Further examples are suitable laminated films are disclosed in WO 02/058910.

Processes for producing water-soluble containers by thermoforming or all vacuum forming are generally known, for example from WO 02/16205. In more detail, in step (a) of the process of the present invention a first pocket is formed in a first water-soluble film by thermoforming or vacuum forming the film in a mould. The film may be drawn down or blown down into the mould. Thus, for example, the film is heated to the thermoforming temperature using a thermoforming heater plate assembly, and then drawn down under vacuum or blown down under pressure into the mould. Plug-assisted thermoforming and pre-stretching the film, for example by blowing the film away from the mould before thermoforming, may, if desired, be used. One skilled in the art can choose an appropriate temperature, pressure or vacuum and dwell time to achieve an appropriate pocket. The amount of vacuum or pressure and thermoforming temperature used depend on the thickness of the film and on the polymer or mixture of polymers being used. Thermoforming of PVOH films is known and described in the above references as well as, for example, in WO 00/55045.

A suitable forming temperature for PVOH is, for example, from 90 to 130° C., especially 90 to 120° C. A suitable forming pressure is, for example, 69 to 138 kPa, especially 83 to 117 kPa. A suitable forming vacuum is 0 to 4 kPa, especially 0 to 2 kPa. A suitable dwell time is, for example, 0.4 to 2.5 seconds, especially 2 to 2.5 seconds.

While desirably conditions are chosen within the above ranges, it is possible to use one or more of these parameters outside the above ranges, when it may be necessary to compensate by changing the values of the other two parameters. The thickness of the first water-soluble film is preferably 30 to 300 μm, more preferably from 40 to 200 μm, especially 50 to 160 μm, more especially from 60 to 150 μm.

After the pocket has been formed it is filled with a first composition in step (b). A suitable composition may be a fabric care, surface care or dishwashing composition, such as a dishwashing, water-softening, laundry or detergent composition or a rinse aid. Such compositions may be suitable for use in a domestic washing machine or domestic dishwasher. The composition may also be a disinfectant, anti-bacterial or antiseptic composition, or a refill composition for a trigger-type spray.

Such compositions are generally packaged in total amounts of from 5 to 100 g, especially from 15 to 40 g. For example, a dishwashing composition may weigh from 15 to 30 g and a water-softener composition may weigh from 15 to 40 g.

The pocket may be completely filled or only partially filled. The first composition may, for example, be a particulate or granulated solid or a tablet. The composition may also be a liquid, which may be thickened or gelled if desired. The liquid composition may be non-aqueous or aqueous, for example comprising less than or more than 5% or less than or more than 10% total of free water. Desirably the composition contains less than 80 wt % water.

The composition may have more than one phase. For example the first composition may comprise an aqueous composition and a liquid composition which is a immiscible with the aqueous composition. The composition may also comprise a liquid composition and a separate solid composition, for example in the form of a ball, pill or speckles. Examples of suitable first compositions are well known to those skilled in the art and are described further in WO 02/085736, the contents of which are herein incorporated by reference.

In step (c) the first pocket is closed with a second water-soluble film to produce an intermediate container. The second water-soluble film may be the same or different from the first water-soluble film. Preferably the second water-soluble film is a PVOH film but generally it will be thinner than the first water-soluble film. The second water-soluble film generally has a thickness of from 20 to 160 μm, preferably from 40 to 100 μm, such as 40 to 80 μm or 50 to 60 μm. The second water-soluble film may be single-layered or laminated. The second water-soluble film may dissolve at the same or a different temperature than that of the first and/or third water-soluble film, for example to ensure that the first and second compositions are released at different times in a wash.

Any method of sealing the second water-soluble film to the first water-soluble film may be used. Preferred methods include the use of an adhesive or heat sealing. Other methods include infra-red, radio frequency, ultrasonic, laser, solvent, vibration and spin welding sealing. The seal desirably is water-soluble.

A suitable heat-sealing temperature is, for example, 120 to 195° C., especially 140 to 150° C. A suitable sealing pressure is, for example, from 250 to 600 kPa, especially 276 to 552 kPa, more especially from 345 to 483 kPa or from 400 to 800 kPa, especially 500 to 700 kPa, for example depending on the heat sealing machine used. Suitable sealing dwell times are 0.4 to 2.5 seconds.

One skilled in the art can use an appropriate temperature, pressure and dwell time to achieve a seal with desired integrity. While desirably conditions are chosen within the above ranges, it is possible to use one or more of these parameters outside the above ranges, although it might be necessary to compensate by changing the values of the other parameters.

Up to this point the process for preparing the water-soluble container is the same or similar to known processes for producing single-compartment containers. However, in step (d) a second pocket is formed by moving the intermediate container by deforming the mould. The mould can be deformed in any way which is sufficient to provide a second pocket which can be filled with a second composition. Desirably, however, at least part of the bottom of the mould is moved away from the mould surface to move the intermediate container away from the surface of the mould to form a second pocket having a bottom formed from the second water-soluble film and sides formed from at least one, and preferably both, of the first water-soluble film and the second water-soluble film. Generally from 50 to 100% of the bottom of the mould, measured by area in which 100% is defined as the area of the open top of the mould, is displaced, generally from 80 to 100%. The displacement of the bottom of the mould is accompanied by consequential movement of the intermediate container downwards. The container may simply move by virtue of gravity. Desirably, however, there are means applied to adhere the container to the bottom of the mould. Preferably the vacuum at the bottom of the mould is maintained therefore "pulling" the intermediate container with the bottom of the mould as it is displaced. Alternatively the intermediate container may be moved by "pushing" the container downwards with air pressure or a tool.

As the intermediate container is moved the first water-soluble film is further stretched. If the second water-soluble film is also present, it is also stretched, although it may, if desired, be removed after the first pocket has been sealed and before step (d). Thus a second pocket is formed having, as its bottom, the upper surface of the second water-soluble film and, as its sides, the first and the second water-soluble films or only the first water-soluble film if the second water-soluble film has been removed. If both the first and the second water-soluble film are present the heat from the sides of the mould may, if desired, at least partially laminate the two films together.

Any mechanism may be used to deform the mould. A preferred mechanism is where the mould comprises a static portion and a movable portion. In this way after step (c) the movable portion may be displaced away from the static portion creating a second pocket. The movable portion may comprise a movable piston After the second pocket has been formed it is filled with the second composition in step (e). The second composition may be the same or different from the first composition. Thus the first or second composition may, for example be a solid and the other a liquid or both may be liquids or both may be solids. Examples of the second composition are the same as those of the first composition given above.

Where one of the pockets comprises a particulate solid/tablet, the compartment may comprise a small aperture, arranged in an outer periphery of the compartment. The aperture may be used for; gas venting where necessary, such as from a per-compound, e.g. a per-carbonate salt; or gas evacuation, e.g. for compartment compaction, for aesthetic reasons.

In step (f) the second pocket is closed with a third water-soluble film. The third water-soluble film may be the same or different as either or both of the first and second water-soluble films. Preferably it is a PVOH film. The third water-soluble film may be sealed to close the second pocket by any desired means such as the means mentioned above. Desirably, however, heat sealing is used. The seal may, if desired, only join the second and third films, or it may join all three films together, particularly if heat sealing is used. This seal may, if desired, incorporate/be directly adjacent to the seal of step (c). Alternatively this seal may be distanced from the seal of step (c).

It will be appreciated that steps (d) to (f) may be repeated, one or more times, to produce, for example, a 3-compartment container.

Once the containers have been produced, they may be separated from each other by cutting the areas between them. Alternatively they may be left conjoined and, for example perforations provided between the individual containers so that they can be easily separated at a later stage, for example by a consumer. If the containers are separated, the flanges may be left in place. However, desirably the flanges are partially removed in order to provide more attractive appearance. Generally the flange remaining should be as small as possible for aesthetic purposes bearing in mind that some flange is required to ensure that the films adhere to each other. A flange having a width of 1 to 8 mm is desirable, preferably 2 to 7 mm, most preferably about 5 mm.

The containers of the present invention may have any desired shape. Generally, however, they will have a relatively constant cross-section since the intermediate container must be able to move within the mould. However, this is not absolutely necessary since the container has a degree of flexibility, especially when the first composition is in the form of a liquid. The cross-section of the container may be, for example, circular, triangular or square.

The compartments may have the same or different size and/or shape from each other. The first pocket is generally larger than the second pocket in order to avoid excessive stretching of the first water-soluble film in step (d). However, the pockets may be of the same size or the first pocket may be smaller than the second pocket if desired.

The volume ratio of the first pocket to the second pocket is desirably from 20:1 to 1:1, most desirably from 10:1 to 2:1.

The containers produced by the process of the present invention will now be further described with reference to FIGS. 1 to 5.

FIG. 1 shows a water-soluble film 1 placed over a mould 2 having a static portion 3 and a moveable portion 4 at the bottom of the mould.

Figure 2:
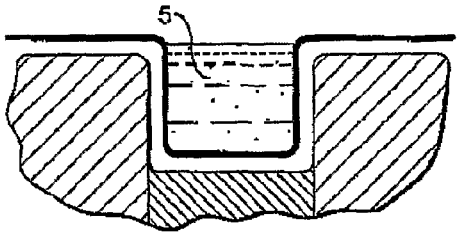

FIG. 2 shows the process of the present invention after step (b) in which the first water-soluble film has been thermoformed or vacuum formed into the mould to form a first pocket and the pocket has been filled with a first composition 5.

Figure 3:
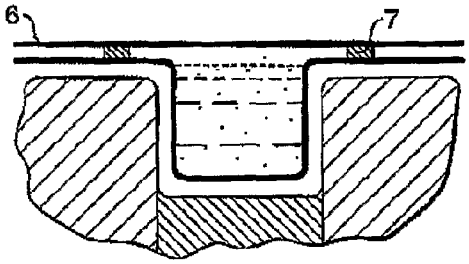

FIG. 3 illustrates the process of the invention after step (c) in which a second water-soluble film 6 is placed above the filled pocket and sealed to the first water-soluble film 1, for example by heat sealing, to form a seal 7.

Figure 4:
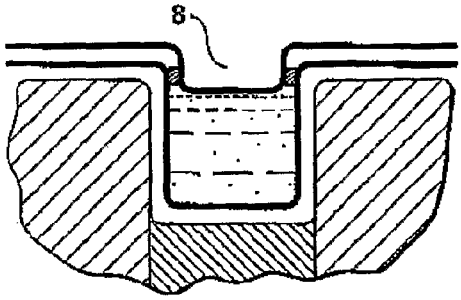

FIG. 4 illustrates the process of the invention after step (d) in which the bottom of the mould 4 is displaced downwards and in which the intermediate container has also been displaced downwards forming a second pocket 8.

Figure 5:
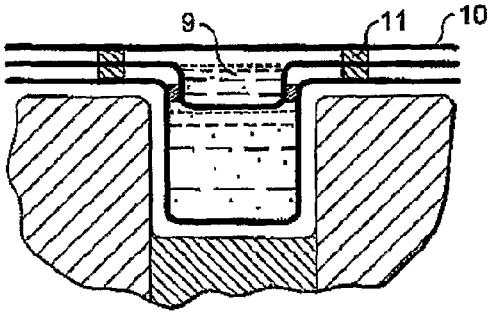

FIG. 5 illustrates the process of the invention after step (f) in which the second pocket 8 has been filled with a second composition 9, a third water-soluble film 10 is provided over the second pocket and sealed to both the first and second water-soluble films by a heat seal 11.

In the Figures seal 7 is shown to be moved from FIG. 3 to FIG. 4. In an alternative to that illustrated seal 7 is retained in its original position and incorporated into seal 11.

The invention claimed is:

1. A process for preparing a water-soluble container comprising at least two compartments which comprises:

a. forming a first pocket in a first water-soluble film by thermoforming or vacuum forming the first water-soluble film in a mould;

b. filling the first pocket with a first composition;

c. dosing the first pocket by sealing with a second water-soluble film to produce an intermediate container;

d. moving the intermediate container by deforming the mould to provide a second pocket;

e. filling the second pocket with a second composition; and f. closing the second pocket by sealing with a third water-soluble film, wherein the seal of step (f) is distanced from the seal of step (c) and wherein the mould is deformed by moving at least part of the bottom of the mould to move the intermediate container and to form the second pocket having a bottom formed from the second water-soluble film and sides formed from the first water-soluble film and optionally the second water-soluble film.

2. A process according to claim 1 wherein the second pocket is bounded by the second water-soluble film.

3. A process according to claim 1 wherein at least one of the first water-soluble film, second water-soluble film and third water-soluble film is a polyvinyl alcohol) film.

4. A process according to claim 1 wherein the first composition and second composition are each fabric care, surface care or dishwashing compositions.

5. A process according to claim 4 wherein the first composition and second composition are each selected from dishwashing, water-softening, laundry, detergent and rinse-aid compositions.

* * * * *